US007262692B2

(12) United States Patent
Ho

(10) Patent No.: US 7,262,692 B2
(45) Date of Patent: Aug. 28, 2007

(54) EMERGENCY EVACUATION GUIDING SYSTEM USING SIGNAL STRENGTH FOR GUIDANCE

(76) Inventor: Ethan Ho, 235 Chung-Ho Box 8-24, Taipei (TW)

( * ) Notice: Subject to any disclaimer, the term of this patent is extended or adjusted under 35 U.S.C. 154(b) by 191 days.

(21) Appl. No.: 11/130,052

(22) Filed: May 17, 2005

(65) Prior Publication Data

US 2006/0261930 A1 Nov. 23, 2006

(51) Int. Cl.
*G08B 29/00* (2006.01)

(52) U.S. Cl. ..... 340/506; 340/628; 340/691.1; 340/691.4; 340/691.6; 342/450; 342/386; 342/357.01; 342/147

(58) Field of Classification Search ..... 340/506, 340/628–630, 584, 600, 691.1–692, 539.13, 340/995.1, 573; 342/450, 458, 386, 357.01, 342/119, 139
See application file for complete search history.

(56) References Cited

U.S. PATENT DOCUMENTS 4,796,018 A * 1/1989 Nakanishi et al. ..... 340/691.1
6,249,221 B1 * 6/2001 Reed ..... 340/539.14

* cited by examiner

*Primary Examiner*—Jeffery Hofsass
*Assistant Examiner*—Hongmin Fan

(57) ABSTRACT

An emergency evacuation guiding system for guiding people to run away in a building system as an accident occurs comprises a detector system for detecting an accidents which is occurred in the building system; an informing system for informing people that an accident occurs; a receiving system for receiving wireless signals from the informing system so as to know the message about the occurring of an accident; a guiding system for guiding people to run away from an accident area to a safety place; the guiding system including the at least one transmitter of the informing system and at least one receiver of the receiving system. The guiding system guides people to run out of the accident area by using the strength of the received signal in the receiver. The receiving system including at least one wireless receiver for detecting the strengths of the signals transmitted from the transmitter to the receiver.

18 Claims, 8 Drawing Sheets

EMERGENCY EVACUATION GUIDING SYSTEM USING SIGNAL STRENGTH FOR GUIDANCE

FIELD OF THE INVENTION

The present invention relates to emergency guidance systems, and in particular to an emergency evacuation guiding system for emergency evacuation of people out of a building or the like when abnormal conditions or accident occurs.

BACKGROUND OF THE INVENTION

Emergency alter systems are widely used in the prior art. There are many patents which disclosed the emergency alter systems. One example is U.S. Pat. No. 4,347,499. The patent relates to an emergency guidance system which provides a plurality of discernable means which are electronically interconnected to provide a sequentially pulsed system that is responsive to sensing means that determine the availability of an exit for use in the event of a catastrophe. Control means are provided that evaluate the input from the sensing means and dependent upon availability of exits cause the discernible means to cycle sequentially through predetermined patterns dictated by the available exits.

In another example, U.S. Pat. No. 6,472,994, a line of illuminated electrically powered exit indicators, each having a power backup is mounted on one surface of a non-conductive tape-like support which is flexible enough to be formed into a roll and bend around corners. The exit indicators and the electric circuits are mounted on one surface of the support. A strong adhesive is applied to the opposite surface of the support so that the exit indicators can be easily attached by the adhesive to surfaces of corridors. The tape-like support is provided with a device which permits the tape-like support to be easily unrolled without stressing the electric circuits on the surface of the tape-like support roll.

In a further example, U.S. Pat. No. 5,140,301, a guidance apparatus in case of emergency evacuation comprising a laser which is disposed within a building or the like in such way that a laser beam emitted from the laser is directed in the direction in which evacuees must escape or is directed from the side of an emergency exit toward the interior of the building or the like; abnormal condition detection means for detecting the occurrence of an abnormal condition in the building or the like and generating a detection signal representative of the occurrence of an abnormal condition; and a control unit which is connected to the laser and the abnormal condition detection means and which, in response to the detection signal, energizes the laser. When an abnormal condition such as fire occurs within the building or the like, the detection means detects the occurrence of an abnormal condition and generates a detection signal, in response to which the laser in energized to emit a laser beam directing the direction in which evacuees must escape.

However, the above-described guidance method or device in the case of emergency evacuation by shouting in loud voices or turning on lighting equipment is almost ineffective when people are seized with panic and if the guidance of people to a safety place by the guides is not carried out satisfactory and properly, the guidance method and device using guides is also ineffective.

SUMMARY OF THE INVENTION

Accordingly, the primary object of the present invention is to provide an emergency evacuation guiding system to overcome the above and other problems encountered in the conventional guidance methods and apparatus in the case of emergency evacuation and has for its object to provide a guidance device in the case of emergency evacuation when a fire or the like happens, which can provide evacuation information to the evacuees and correctly guide them to a safe place.

To achieve above objects, the present invention provides an emergency evacuation guiding system for guiding people to run away in a building system as an accident occurs. The emergency evacuation guiding system comprises a detector system for detecting an accidents which is occurred in the building system; an informing system for informing people that an accident occurs in the building system; the informing system including at least one transmitter for transmitting wireless signals; wherein when the detector detects that an accident occurs, the transmitter will emit signals to inform the accident to other people; a receiving system for receiving wireless signals from the informing system so as to know the message about the occurring of an accident; the receiving system including at least one wireless receiver for detecting the strengths of the signals transmitted from the transmitter to the receiver, and a guiding system for guiding people to run away from an accident area to a safety place; the guiding system including the at least one transmitter of the informing system and at least one receiver of the receiving system; the guiding system guiding people run out of the accident area by using the strength of the received signal in the receiver.

The various objects and advantages of the present invention will be more readily understood from the following detailed description when read in conjunction with the appended drawing.

DETAILED DESCRIPTION OF THE INVENTION

Figure 1:
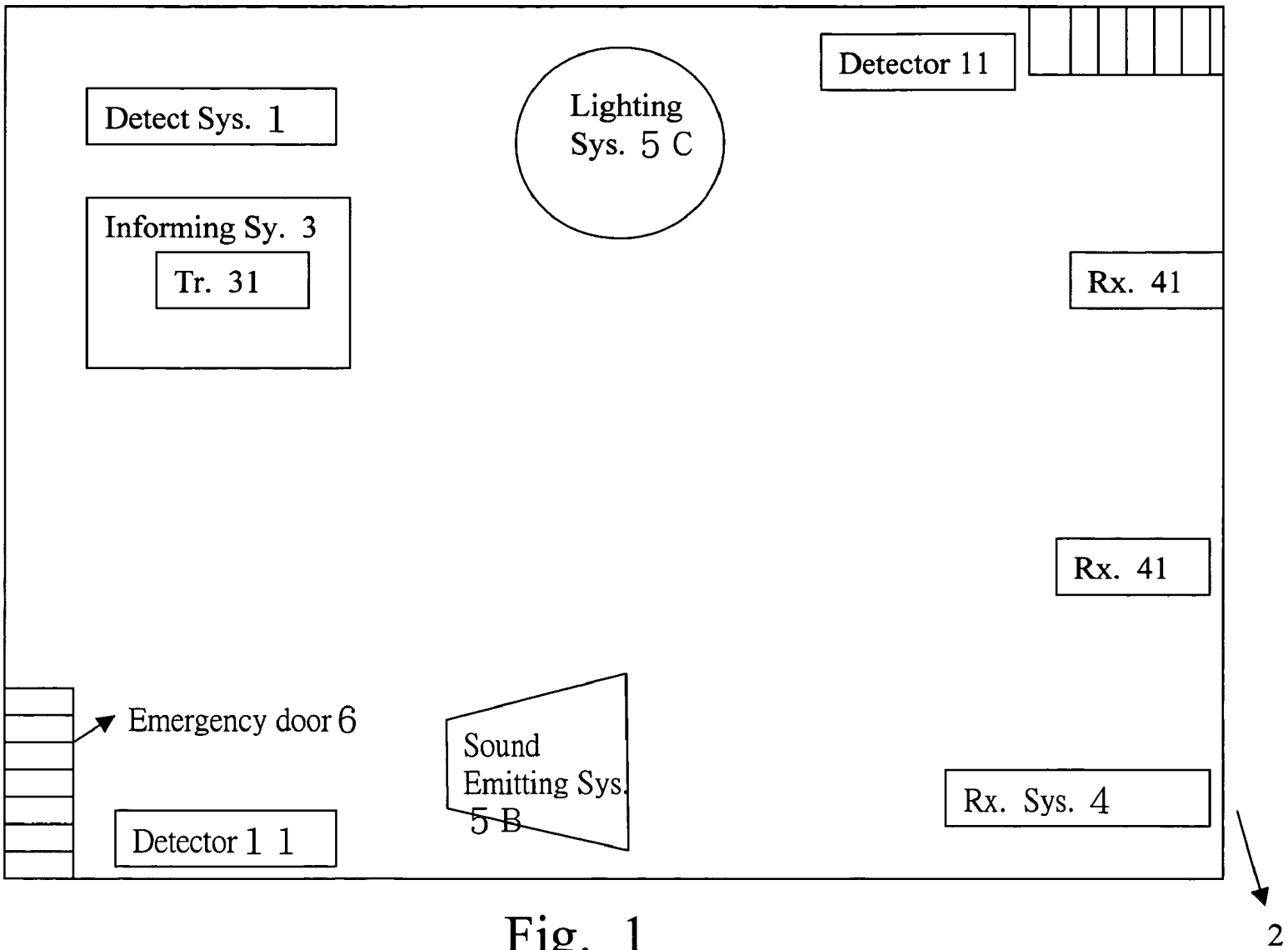
FIG. 1 shows a possible arrangement of the present invention.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Please referring to FIGS. 1 to 4, the emergency evacuation guiding system of the present invention is illustrated. In this embodiment, a structure about the emergency evacuation guiding system of the present invention will be intruded. A detector system 1 serves to detect the possible accidents which can be occurred in a building system 2. The detector system 1 has at least one detector 11. If there is more than one detector 11 is used, for example two detectors 11 are used, then they are installed to different locations for detecting the conditions of the respective area. In the present invention, the building system 2 may be for example, a hotel, a hospital, a plant (for example, a power plant), a bus station, a train station, a cruise ship, etc. However in this embodiment, a hotel is used as an example to describe the present invention. The accident is for example fire accident, earthquake, etc. In this embodiment, a fire accident is used as an example to describe the present invention. Thereby, the detector 11 is a fire sensor.

An informing system 3 serves to inform the accident to people in the building system 2. In the present invention, the informing system 3 includes a wireless transmitting system 3 which includes at least one transmitter 31 for transmitting wireless signals. When the detector 11 detects that an accident occurs, the transmitter 31 will emit signals to inform the accident to other people. In a preferable example, the transmitter 31 is installed aside or near a door so that the people can go toward the place for running away. However this is only one scope of the present invention, it does not confine the scope of the present invention. For example, in a plant, the transmitter 31 may be placed in one end of a running path.

A receiving system 4 serves for receiving wireless signals from the informing system 3 (the at least one transmitter 31) so as to know the message about the occurring of an accident. The receiving system 4 includes at least one wireless receiver 41.

Figure 3:
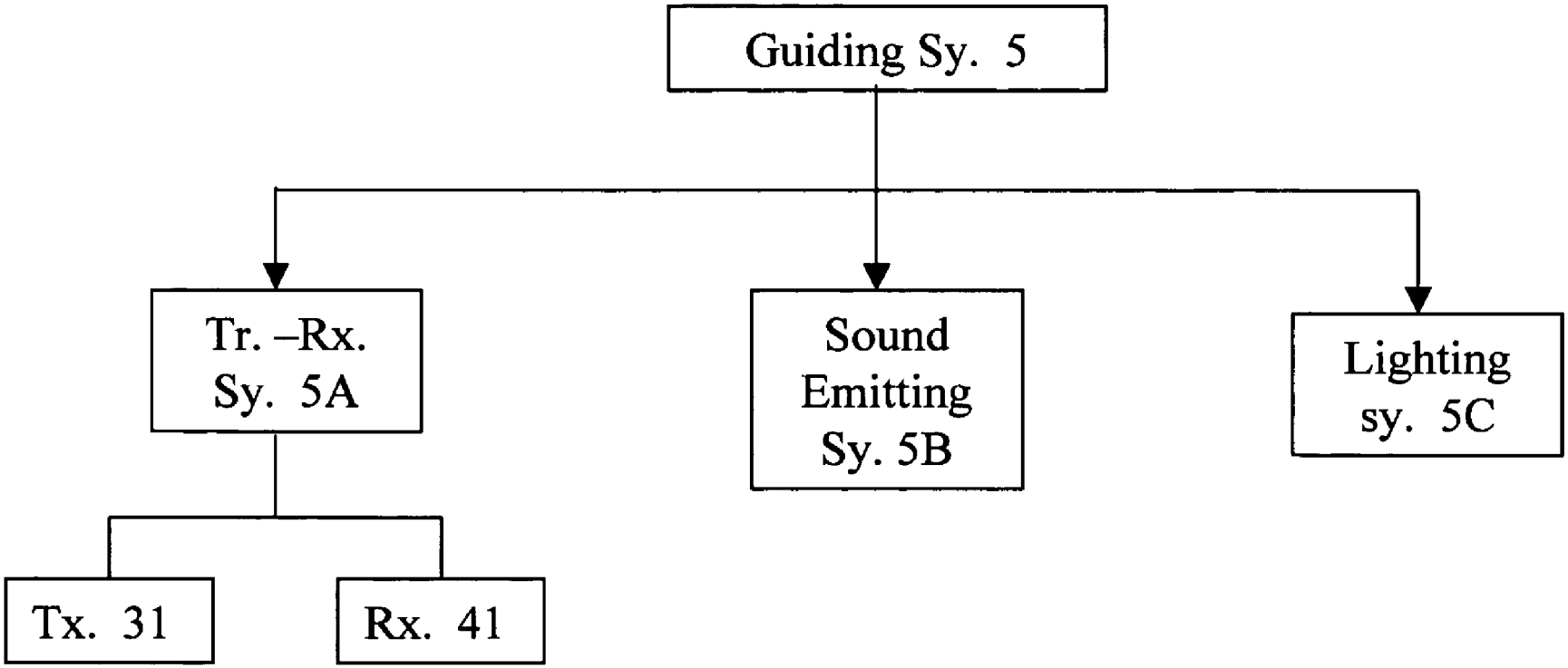
FIG. 3 is a functional block diagram showing the arrangement of the guiding system of the present invention.

A guiding system 5, referring to FIG. 3, serves for guiding people to run away from the accident area to a safety area. The guiding system 5 includes at least one sub-system. One sub-system 5A is a wireless transmitter-receiver system 5A which includes at least one transmitter 31 and at least one receiver 41.

In the present invention, the transmitter 31 is associated to respective detectors 11. If the detector 11 is actuated so as to sense that an accident occurs, then the associated transmitter 31 will actuate so as to transmit signal. It should be noted that the transmitter 31 is out of an area covering by the associated detector 11 so that an area is detected to occur an accident, the associated transmitter 31 not within the area will emit signals to inform people to run out and then the transmitter 31 is also used to guide people to run out of the area. The detector 11 is connected to the transmitter 31 by wired or wireless connection. Wireless connection is a preferred way since it can prevent the connection from being damaged due to the accident.

Figure 2:
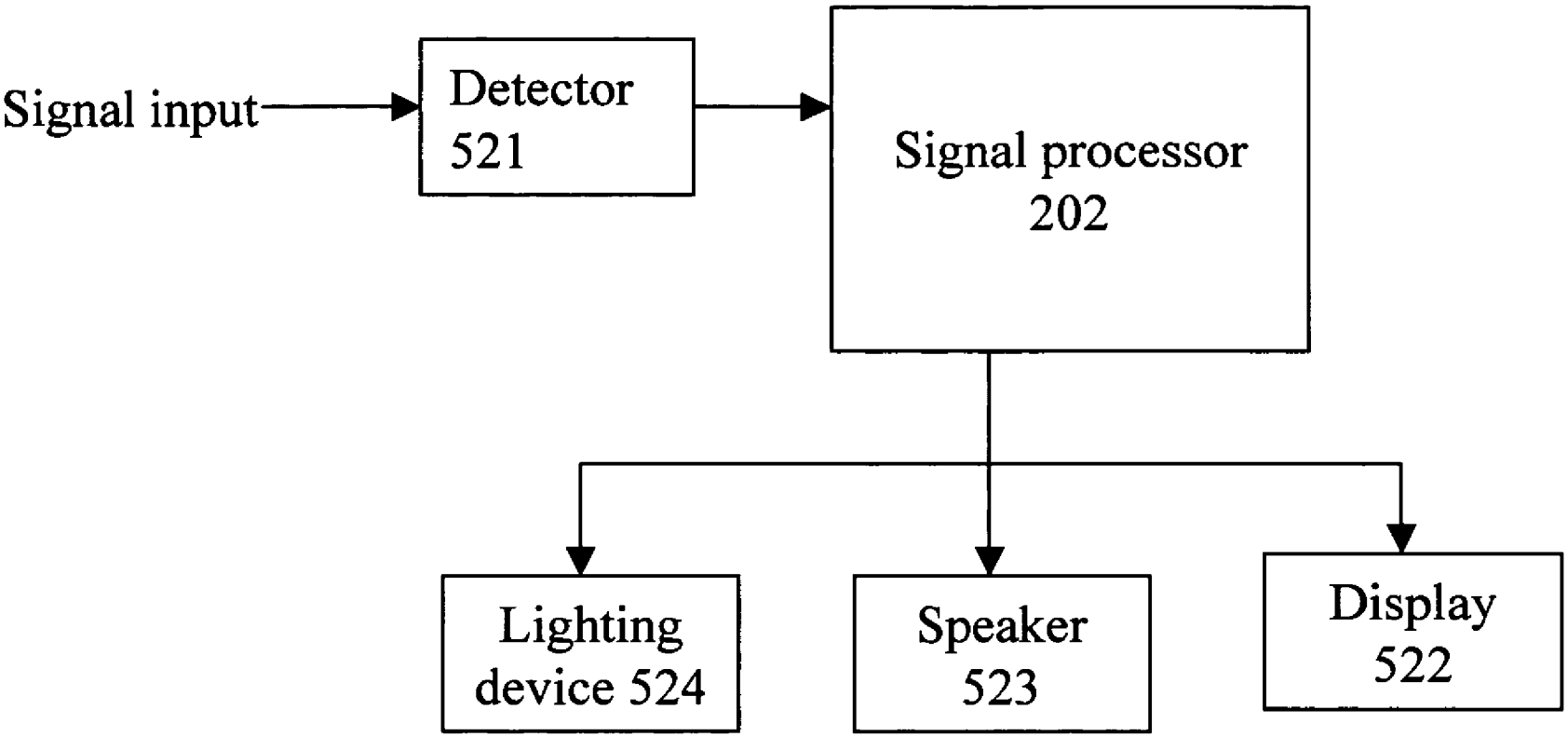
FIG. 2 is a functional block diagram showing arrangement of the receiver of the present invention.

Referring to FIG. 2, the receiver 41 includes a detector 521 for detecting the strengths of the signals transmitted from the transmitter 31 to the receiver 41, a display 522 for displaying the strengths of the signals, a speaker 523 which emits sound according to the strengths of the signals, for example a great sound for strong strength and a lighting device 524 which can emit light to alert people to run away along a predetermined path. Thereby people in the accident occurring place can run away according to the guiding of the volume of the sound from the speaker 523. Since in the present invention, the actuated transmitter 31 is generally installed near an emergency door. The larger the strength, the greater the strength of the signal (or the volume of the sound). Thereby people can go to the emergency door.

In the present invention, the receiver 41 is installed in a key, a flashlight, an oxygen mask, an indicator box, a TV controller or a rescuing cloth used in a boat or a plane.

In the present invention some sub-systems can work with the wireless transmitter-receiver system 5A. One of the sub-systems is a sound emitting system 5B serves to guide the people to go out of an accident area by sounds. The sound emitting system 5B works with the wireless transmitter-receiver system 5A. As the transmitter 31 emits inform signals to the receiver 41. The sound emitting system 5B still actuate so as to emit sound to guide the people to run out from the accident area.

A further sub-system is a lighting system 5C which emits light to guide people to run out of the accident area. The lighting system 5C has a plurality of lighting units 5C1. Each lighting unit 5C1 has at least one associated transmitter 31. The lighting unit can alert the people to run along a safety way. In a path to a safety door or an emergency door, there may be a plurality of lighting units 5C1 are installed. Strong light is used to indicate a correct path and weak light indicates a wrong path. Thereby people can easily run away from the accident area.

Figure 4:
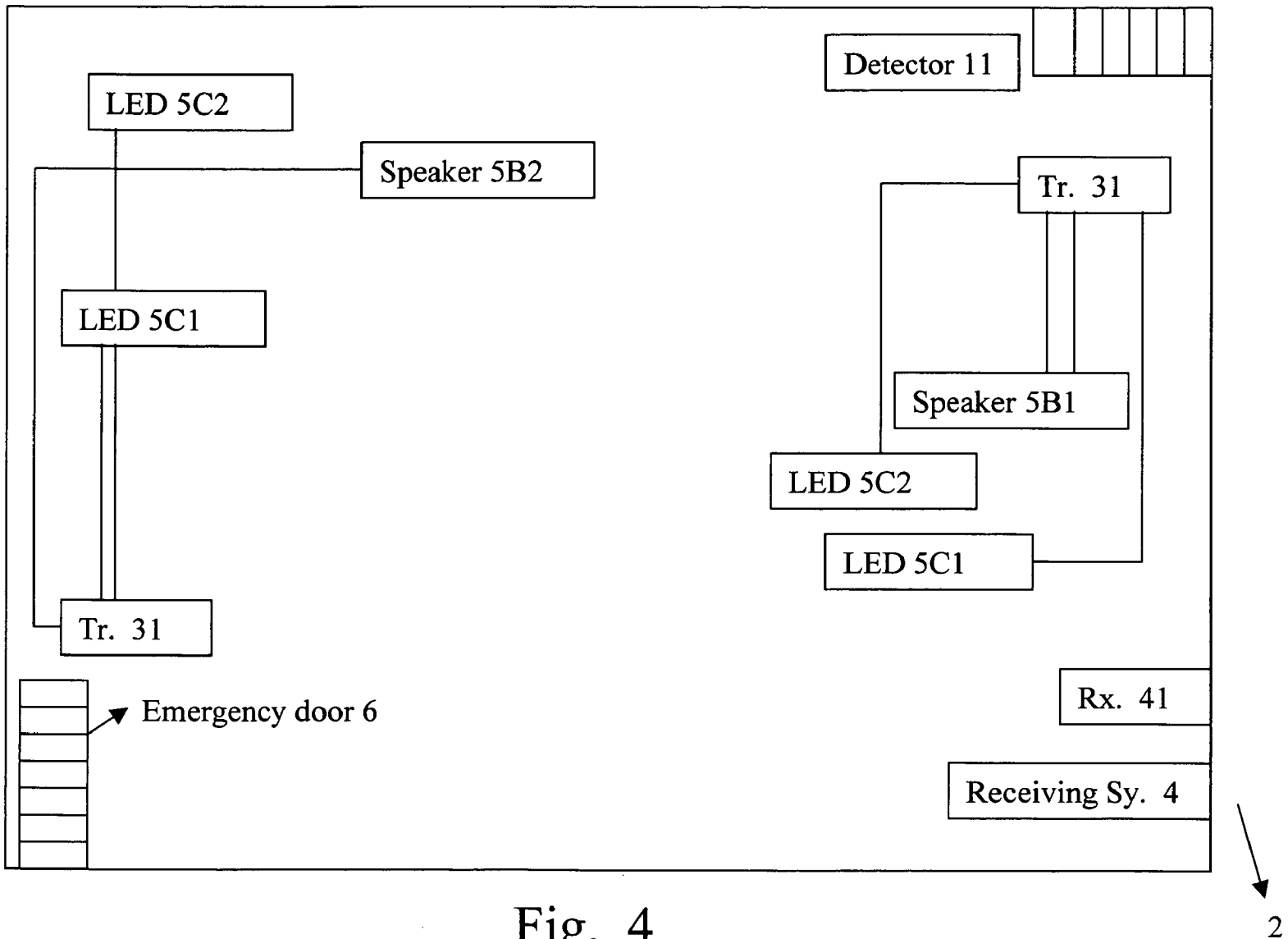
FIG. 4 shows one embodiment about the arrangement of the present invention.

Referring to FIG. 4, in the present invention, all the sub-systems 5A, 5B and 5C of the guiding system 5 can be integrated as illustrated. Namely, the transmitter 31 in the sub-system 5A has associated elements. From FIG. 4, it is shown that there are two sets of guiding elements. Each of the light devices LED 5C1, 5C2 has associated transmitter 31. If the transmitter 31 actuates, only related devices connected thereto will actuates. Thereby if one transmitter 31 is near the accident area, the related devices will not actuate and thus people will not be guided along the path guided by these devices.

Figure 5:
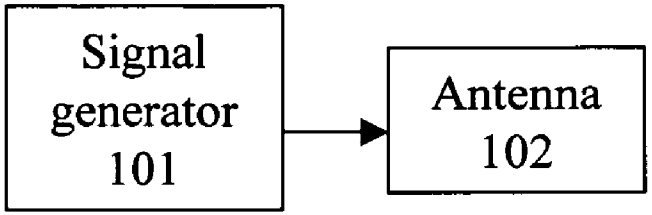
FIG. 5 is a functional block diagram showing the first arrangement of the transmitter of the present invention.

In the first form of the transmitter 31, see FIG. 5, the transmitter 31 includes a signal generator 101 for generating signals and an antenna 102 for transmitting the signal from the signal generator 101. In the present invention, a simplest form of the signal generator 101 is an oscillator which generates a single frequency signal. The signal is then transferred out so that the receiver 41 can receive the signal to know an accident being occurred and moreover the receiver 41 can know the position of an emergency door so that the user of the receiver 41 can run away from the accident field.

Figure 6:
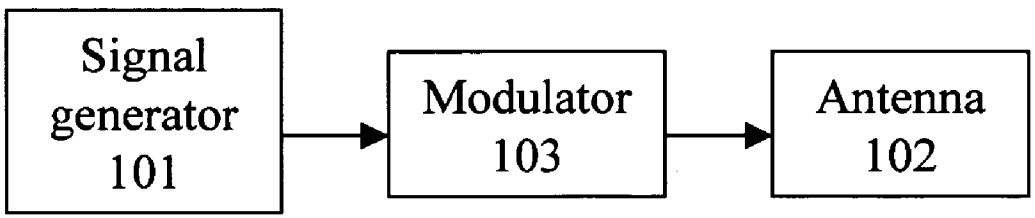
FIG. 6 is a functional block diagram showing the second arrangement of the transmitter of the present invention.

In a more complex circuit structure in the second form of the transmitter 31, see FIG. 6, the transmitter has a signal generator 101, an antenna 102, and a modulator 103. The signal generator 101 may be a digital signal generator or an analog signal generator for generating message carrying signals. The modulator 103 is an up-converter for up-converting the frequencies of the signals to the frequencies to be emitted out by the antenna 102. The modulator 103 generally includes an oscillator 1031 and a multiplier 1032 for adding the carrier frequency from the oscillator 1031 to the signals so that the signal has desired frequencies to be efficiently transmitted by the transmitter.

Figure 7:
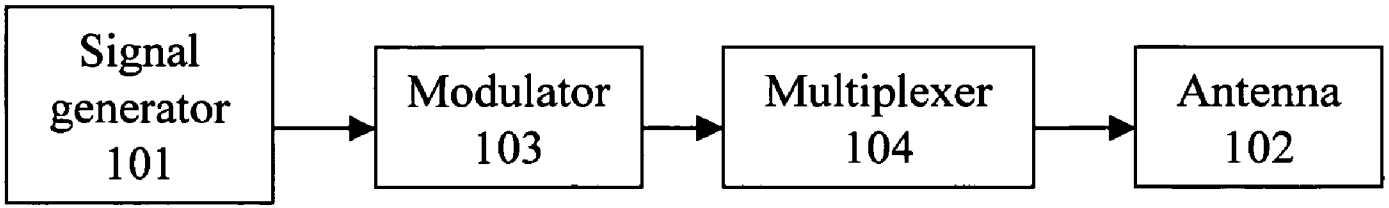
FIG. 7 is a functional block diagram showing the third arrangement of the transmitter of the present invention.

In a more complex circuit structure, see FIG. 7, the transmitter 31 includes a signal generator 101, an antenna 102, a modulator 103, and a multiplexer 104. The structures of the signal generator 101, an antenna 102, a modulator 103 are identical to above mentioned, and thus the details will not be described herein. However the multiplexer 104 serves to adjust the frequency band of the modulated signal to a desired channel so as to be sent to the antenna 102 for transmission.

Figure 8:
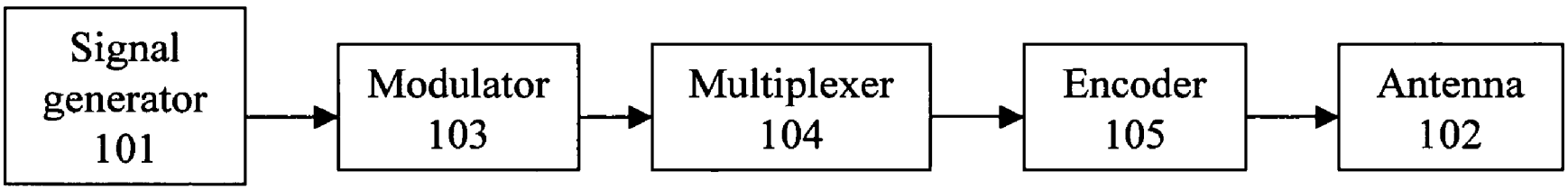
FIG. 8 is a functional block diagram showing the fourth arrangement of the transmitter of the present invention.

In a more complex circuit structure, see FIG. 8, the transmitter 31 includes a signal generator 101, an antenna 102, a modulator 103, a multiplexer 104 and an encoder 105. The structures of the signal generator 101, an antenna 102, a modulator 103 and the multiplexer 104 are identical to above mentioned, and thus the details will not be described herein. However the encoder 105 serves to encode the multiplexed signals into coded signals for further transmitting to the antenna 102.

Figure 9:
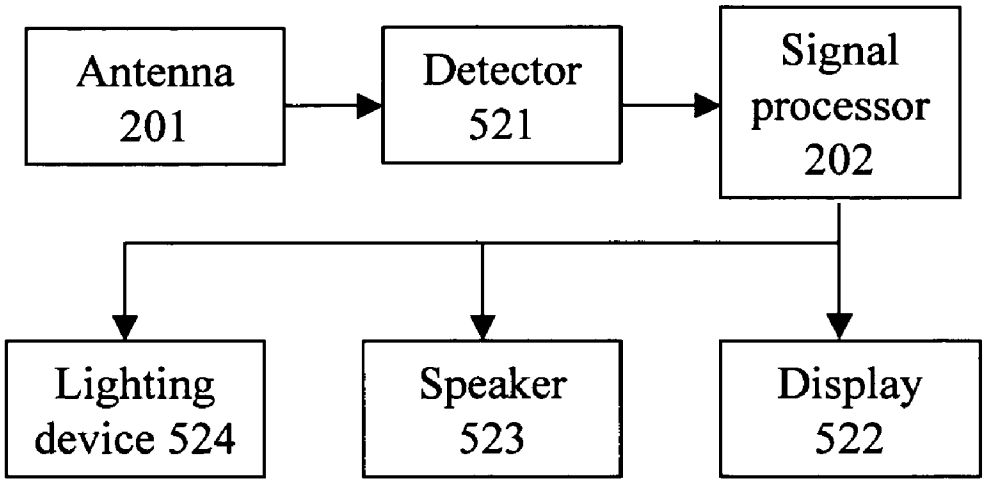
FIG. 9 is a functional block diagram showing the first arrangement of the receiver of the present invention.

In the simplest structure, referring to FIG. 9, it is illustrated that the receiver 41 has an antenna 201, and a signal processor 202 other than above mentioned display 522 and the speaker 523 or the light device 524. The signal processor 202 processes the received signals from the transmitter 31 and then measures the strengths of the receiving signals, converting the strengths into indications to be displayed on the display 522 and to make the speaker 523 to emit sound with strengths positively related to the strengths of the receiving signals.

Figure 10:
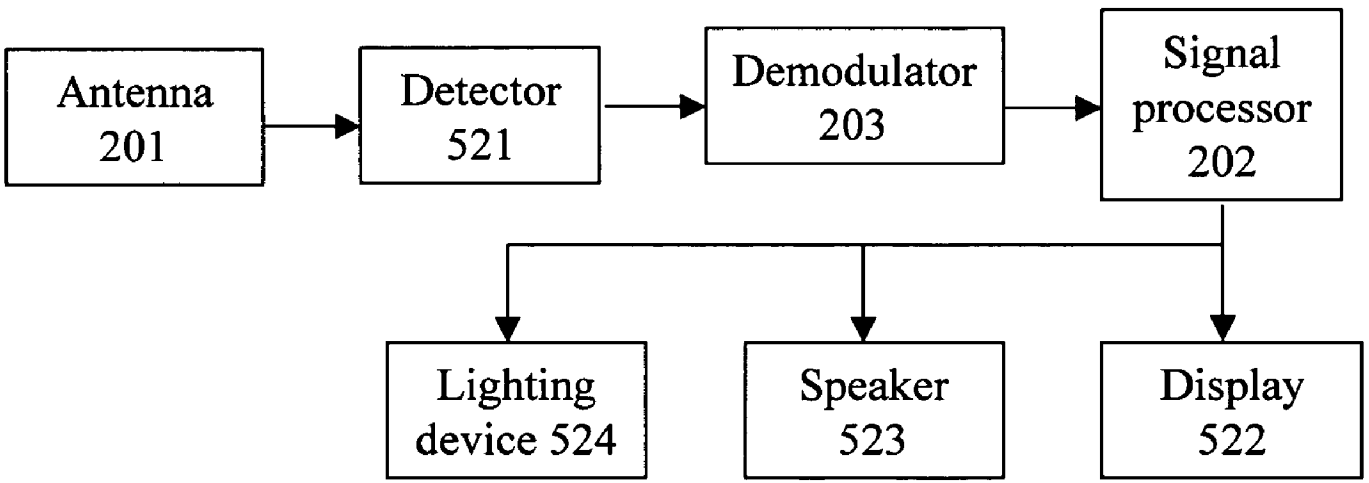
FIG. 10 is a functional block diagram showing the second arrangement of the receiver of the present invention.

In another structure, referring to FIG. 10, it is illustrated that the receiver 41 has an antenna 201, a signal processor 202, a demodulator 203 other than the above mentioned display 522 and the speaker 523 or the light device 524. This embodiment is corresponding to the embodiment of that is illustrated in FIG. 9, but a demodulator 203 is added. The demodulator 203 serves to demodulate the signals from the transmitter 31 having the modulator 103 and then send the signals into the signal processor 202. The signal processor 202 does the same work as above said. However the signals from the transmitter 31 may include other messages which are also processed by the signal processor 202 as those used in the prior arts.

Figure 11:
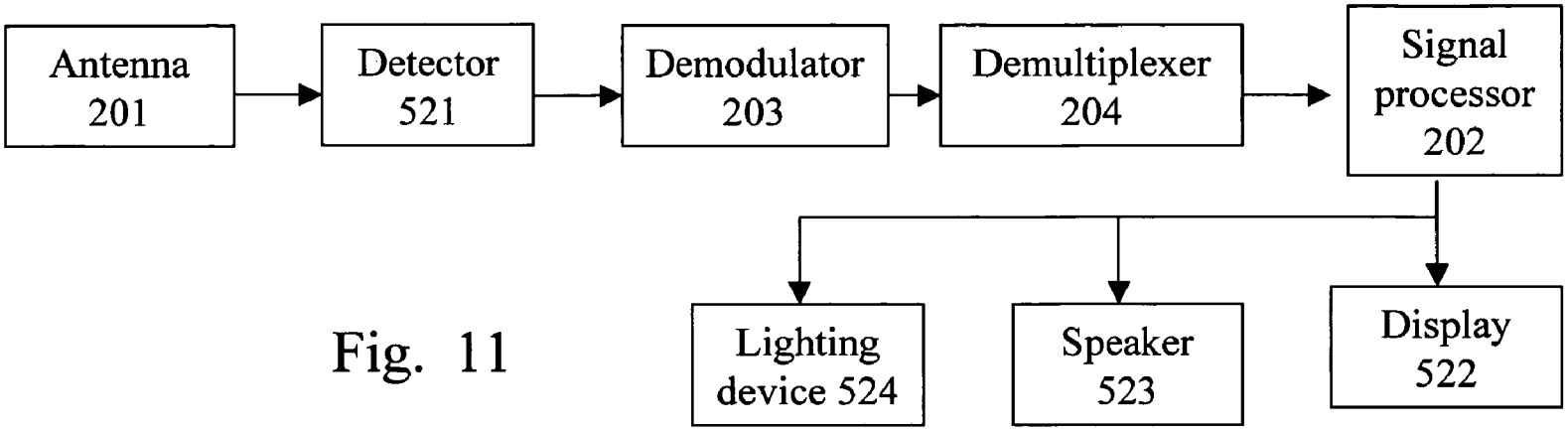
FIG. 11 is a functional block diagram showing the third arrangement of the receiver of the present invention.

In a further structure, referring to FIG. 11, it is illustrated that the receiver 41 has an antenna 201, a signal processor 202, a demodulator 203, and a demultiplexer 204, other than the above mentioned display 522 and the speaker 523 or the lighting device 524. This embodiment is corresponding to the embodiment of that is illustrated in FIG. 10, but a demultiplexer 204 is added. The demultiplexer 204 serves to demultiplex the signals from the transmitter 31 having the modulator 103 and then send the signals into the demodulator 203 and the signal processor 202 which do the same works as above mentioned and thus the details will not be further described herein.

Figure 12:
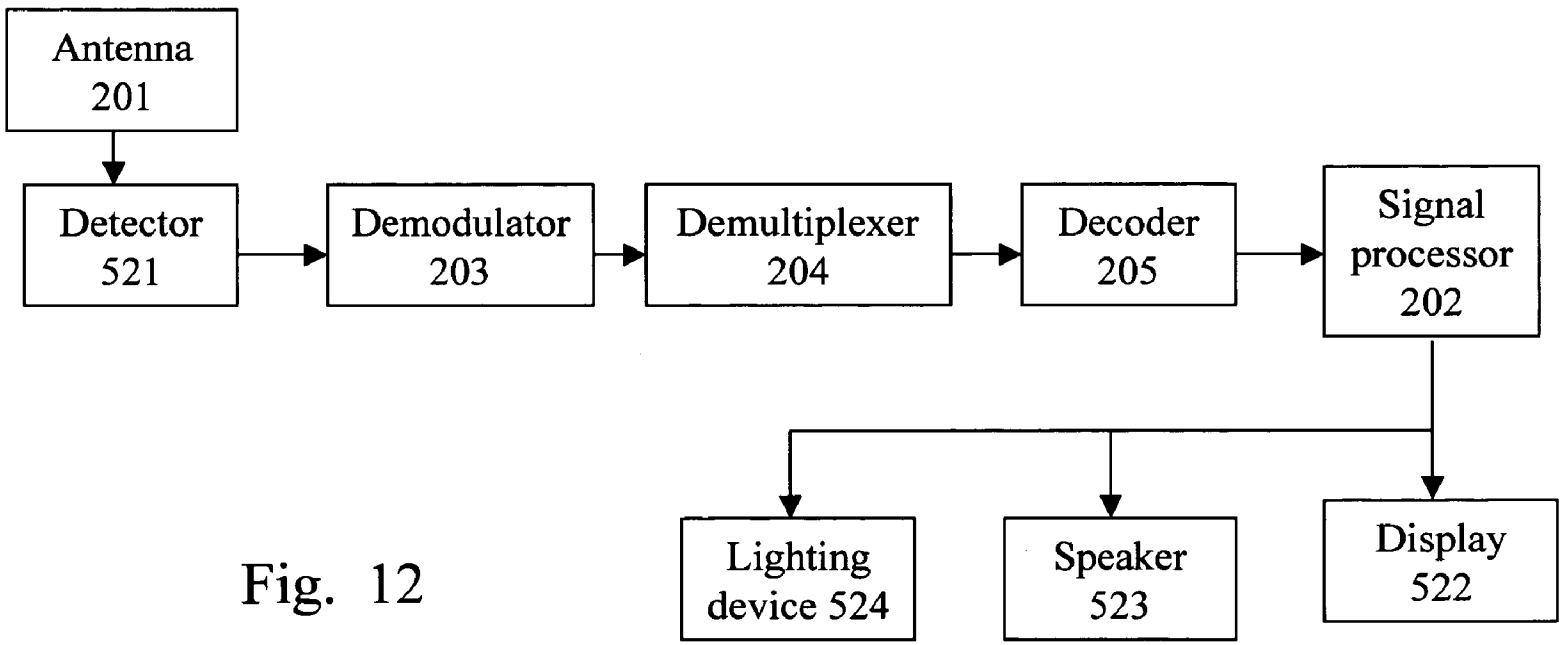
FIG. 12 is a functional block diagram showing the fourth arrangement of the receiver of the present invention.

In a yet structure, referring to FIG. 12, it is illustrated that the receiver 41 has an antenna 201, a signal processor 202, a demodulator 203, a demultiplexer 204, and a decoder 205 other than the above mentioned display 522 and the speaker 523 or the light device 524. This embodiment is corresponding to the embodiment of that illustrated in FIG. 11, but a decoder 205 is added. The decoder 205 serves to decode the signals from the transmitter 31 having the modulator 103. The antenna 201, signal processor 202, demodulator 203, and demultiplexer 204 do the same works as above mentioned and thus the details will not be further described herein.

In the present invention, the guiding of the running away path can be achieved by the design of antenna beam. The directivity of the antenna beam can be used to match a run-away path.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An emergency evacuation guiding system for guiding people to run away in a building system as an accident occurs, comprising:

a detector system for detecting an accident which has occurred in the building system;

an informing system for informing people that an accident has occurred in the building system; the informing system including at least one transmitter for transmitting wireless signals; wherein when the detector detects that an accident has occurred, the transmitter will emit signals to inform the accident to people in the building;

a receiving system for receiving wireless signals from the informing system to know the message about the occurring of an accident; the receiving system including at least one wireless receiver for detecting the strength of the signals transmitted from the transmitter to the receiver, a guiding system for guiding people to run away from an accident area to a safety place; the guiding system including the at least one transmitter of the informing system and at least one receiver of the receiving system; the guiding system guiding people run out of the accident area by using the strength of the received signal in the receiver.

2. The emergency evacuation guiding system as claimed in claim 1, wherein the receiver includes a detector for detecting the strength of the signals transmitted from the transmitter to the receiver, a display for displaying the strength of the signals, a speaker which emits sound according to the strength of the signals; the larger the strength, the greater the strength of the signal; and a lighting device which can emit light to alert people.

3. The emergency evacuation guiding system as claimed in claim 1, wherein the guiding system further comprises a sound emitting system for guiding the people to go out of an accident area by sounds; as the transmitter emits informing signals to the receiver; the sound emitting system still actuate so as to emit sound to guide the people to run out from the accident area.

4. The emergency evacuation guiding system as claimed in claim 1, wherein the guiding system further comprises a lighting system which emits light to guide people to run out of the accident area.

5. The emergency evacuation guiding system as claimed in claim 4, wherein the lighting system has a plurality of lighting units; strong light is used to indicate a correct path and weak light indicates a wrong path.

6. The emergency evacuation guiding system as claimed in claim 1, wherein if there is more than one detector is used, they are installed to different locations for detecting the conditions of the respective area.

7. The emergency evacuation guiding system as claimed in claim 1, wherein the building system is one of a hotel, a hospital, a plant, a bus station, a train station, a museum, a cruise ship, a library, and public places.

8. The emergency evacuation guiding system as claimed in claim 1, wherein the transmitter further includes a signal processor and an antenna.

9. The emergency evacuation guiding system as claimed in claim 8 wherein the signal processor includes an oscillator.

10. The emergency evacuation guiding system as claimed in claim 8, wherein the transmitter further includes a modulator.

11. The emergency evacuation guiding system as claimed in claim 10, wherein the transmitter further includes a multiplexer.

12. The emergency evacuation guiding system as claimed in claim 11, wherein the transmitter further includes an encoder.

13. The emergency evacuation guiding system as claimed in claim 1, wherein the receiver includes:

a detector for detecting the strength of the signals transmitted from the transmitter to the receiver, a display for displaying the strength of the signals;

a speaker which emits sound according to the strength of the signals; and a lighting device for emitting light to alert people to run away along a predetermined path.

14. The emergency evacuation guiding system as claimed in claim 1, wherein the receiver further includes a signal processor for processing the received signals from the transmitter and measuring the strength of the receiving signals.

15. The emergency evacuation guiding system as claimed in claim 14, wherein the receiver further includes a demodulator.

16. The emergency evacuation guiding system as claimed in claim 15, wherein the receiver further includes a demultiplexer.

17. The emergency evacuation guiding system as claimed in claim 16, wherein the receiver further includes a decoder.

18. The emergency evacuation guiding system as claimed in claim 1, wherein the receiver is installed in one of a key, a flashlight, an oxygen mask, an indicator box, a TV controller and an emergency rescuing cloth used in a boat or a plane.

* * * * *